US011705654B2

(12) United States Patent
Oshita

(10) Patent No.: US 11,705,654 B2
(45) Date of Patent: Jul. 18, 2023

(54) TERMINAL FITTING AND CHAIN TERMINAL

(71) Applicant: SUMITOMO WIRING SYSTEMS, LTD., Mie (JP)

(72) Inventor: Takuya Oshita, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 57 days.

(21) Appl. No.: 17/395,315

(22) Filed: Aug. 5, 2021

(65) Prior Publication Data

US 2022/0069499 A1 Mar. 3, 2022

(30) Foreign Application Priority Data

Aug. 25, 2020 (JP) ..... 2020-141740

(51) Int. Cl.
*H01R 13/11* (2006.01)
*H01R 13/05* (2006.01)

(52) U.S. Cl.
CPC ..... *H01R 13/057* (2013.01); *H01R 13/111* (2013.01)

(58) Field of Classification Search
CPC ..... H01R 13/057; H01R 13/111
USPC ..... 439/852
See application file for complete search history.

(56) References Cited

U.S. PATENT DOCUMENTS 6,439,935 B2 * 8/2002 Saka ..... H01R 13/113 439/852
6,905,376 B2 * 6/2005 Chen ..... H01R 13/113 439/852
7,048,582 B2 * 5/2006 Tabata ..... H01R 43/16 439/852
7,144,281 B2 12/2006 Maeda
7,252,564 B1 * 8/2007 Morello ..... H01R 13/11 439/877
7,988,505 B2 * 8/2011 Hotea ..... H01R 13/11 439/852
8,241,076 B2 * 8/2012 Kubota ..... H01R 13/193 439/852
8,905,798 B2 12/2014 Amano et al.
9,318,825 B2 * 4/2016 Taguchi ..... H01R 13/428
9,735,490 B2 * 8/2017 Wu ..... H01R 13/113
10,193,258 B2 * 1/2019 Balser ..... H01R 13/18
(Continued)

FOREIGN PATENT DOCUMENTS

JP 2010-073440 A 4/2010

*Primary Examiner* — Abdullah A Riyami
*Assistant Examiner* — Vladimir Imas
(74) *Attorney, Agent, or Firm* — Venjuris, P.C.

(57) ABSTRACT

A terminal fitting includes a body portion, a first projection, a resilient contact portion and a first fulcrum portion. The body portion is in the form of a rectangular tube open in a front-rear direction. The first projection projects from one wall part toward another wall part, out of two wall parts of the body portion adjacent across one corner. The resilient contact portion is arranged in the body portion. The first fulcrum portion serves as a fulcrum when the resilient contact portion is deflected and deformed. In a developed state of the terminal fitting along the front-rear direction and a width direction, one side end of the resilient contact portion is arranged on one side end part in the width direction. A tip of the first projection is arranged on another side end part in the width direction.

7 Claims, 7 Drawing Sheets

(56) References Cited

U.S. PATENT DOCUMENTS

| | | | | |
|---|---|---|---|---|
| 10,297,940 | B2 * | 5/2019 | Tanikawa | H01R 13/113 |
| 11,217,925 | B2 * | 1/2022 | Tsuchiya | H01R 13/114 |
| 11,342,699 | B2 * | 5/2022 | Hirota | H01R 13/5808 |
| 2005/0287877 | A1 * | 12/2005 | Fukuda | H01R 13/187<br>439/850 |
| 2011/0212656 | A1 * | 9/2011 | Suzuki | H01R 13/114<br>439/852 |
| 2013/0102180 | A1 * | 4/2013 | Muro | H01R 13/114<br>439/345 |
| 2015/0207255 | A1 * | 7/2015 | Sugiyama | H01R 13/11<br>439/852 |
| 2016/0020541 | A1 * | 1/2016 | Takamura | H01R 13/111<br>439/816 |

* cited by examiner

TERMINAL FITTING AND CHAIN TERMINAL

CROSS-REFERENCE TO RELATED APPLICATIONS

This application is based on and claims priority from Japanese Patent Application No. 2020-141740, filed on Aug. 25, 2020, with the Japan Patent Office, the disclosure of which is incorporated herein in their entireties by reference.

TECHNICAL FIELD

The present disclosure relates to a terminal fitting and a chain terminal.

BACKGROUND

A female terminal fitting is disclosed in Japanese Patent Laid-open Publication No. 2013-251072, Japanese Patent Laid-open Publication No. 2010-073440, and Japanese Patent No. 4075825. This terminal fitting is manufactured as follows. First, a chain terminal is manufactured by stamping a metal plate. The chain terminal includes a strip-like carrier and a plurality of terminal fittings in a developed state. The plurality of terminal fitting in the developed state are individually coupled to the carrier along a length direction of the carrier. The terminal fittings in the developed state are individually separated from the carrier and bending and the like are applied thereto. In this way, the terminal fittings are manufactured.

SUMMARY

In the terminal fittings of this type, an arrangement interval of the terminal fittings in the developed state coupled to the carrier is required to be made smaller from a viewpoint of improving a yield. The terminal fitting of Japanese Patent Laid-open Publication No. 2013-251072 includes a projection on one side and a recess on another side in a width direction in the developed state. In adjacent two terminal fittings, the projection of one terminal fitting is arranged to face the recess of another terminal fitting. Thus, the one terminal fitting can be placed closer to the other terminal fitting, with the result that the arrangement interval of the terminal fittings can be made smaller. However, in a configuration in which a resilient contact portion configured to contact a tab of a mating terminal fitting is provided on another side end part of the terminal fitting, if the recess is provided on the other side end part of the terminal fitting, a width becomes partially smaller and a stress generated when the resilient contact portion is deflected and deformed may concentrate.

Accordingly, the present disclosure aims to improve a yield while suppressing the concentration of a stress generated when a resilient contact portion is deflected and deformed.

A terminal fitting of the present disclosure includes a body portion in the form of a rectangular tube open in a front-rear direction, a projection projecting from one wall part toward another wall part, out of two wall parts of the body portion adjacent across one corner, a resilient contact portion arranged in the body portion, and a fulcrum portion serving as a fulcrum when the resilient contact portion is deflected and deformed, wherein, in a developed state along the front-rear direction and a width direction, one side end of the resilient contact portion is arranged on one side end part in the width direction, a tip of the projection is arranged on another side end part in the width direction, and a recess is provided at a position overlapping the projection when viewed from the width direction and separated from the fulcrum portion in the front-rear direction on the one side end of the resilient contact portion.

A chain terminal of the present disclosure includes a plurality of the terminal fittings of the present disclosure in the developed state, and a carrier extending in the width direction, wherein the plurality of terminal fittings are coupled to the carrier while being arranged in the width direction, and the recess and the projection are arranged to face each other via a clearance between the terminal fittings adjacent in the width direction.

According to the present disclosure, it is possible to improve a yield while suppressing the concentration of a stress generated when a resilient contact portion is deflected and deformed.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
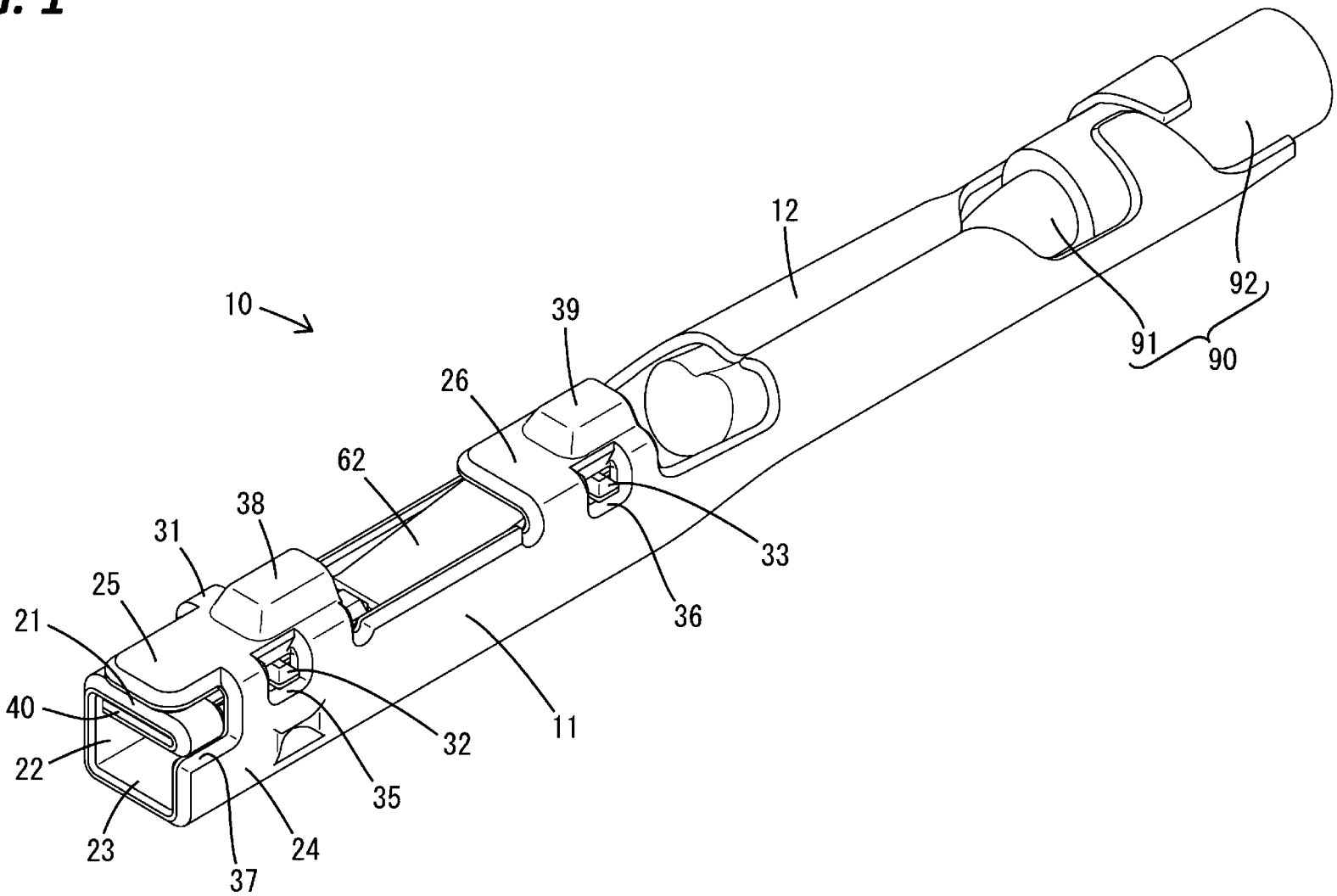
FIG. 1 is a perspective view of a terminal fitting according to one embodiment viewed from right.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Description of Embodiments of Present Disclosure

First, embodiments of the present disclosure are listed and described.

(1) The terminal fitting of the present disclosure includes a body portion in the form of a rectangular tube open in a front-rear direction, a projection projecting from one wall part toward another wall part, out of two wall parts of the body portion adjacent across one corner, a resilient contact portion arranged in the body portion, and a fulcrum portion serving as a fulcrum when the resilient contact portion is deflected and deformed, wherein, in a developed state along the front-rear direction and a width direction, one side end of the resilient contact portion is arranged on one side end part in the width direction, a tip of the projection is arranged on another side end part in the width direction, and a recess is provided at a position overlapping the projection when viewed from the width direction and separated from the fulcrum portion in the front-rear direction on the one side end of the resilient contact portion.

In this terminal fitting, the one side end of the resilient contact portion is arranged on the one side end part and the tip of the projection is arranged on the other side end part. The recess is provided at the position overlapping the projection when viewed from the width direction on the one side end of the resilient contact portion. Thus, in the case of manufacturing a chain terminal in which a plurality of the terminal fittings in the developed state are arranged in the width direction and individually coupled to a carrier, the recess of one terminal fitting, out of adjacent two terminal fittings, is arranged to face the projection of another terminal fitting in the width direction. Thus, according to this terminal fitting, an arrangement interval of the terminal fittings in the chain terminal can be made smaller. Further, the recess is provided at the position separated from the fulcrum portion in the front-rear direction. Thus, the concentration of a stress generated when the resilient contact portion is deflected and deformed can be suppressed. Therefore, according to this terminal fitting, a yield can be improved while the concentration of a stress generated when the resilient contact portion is deflected and deformed is suppressed.

(2) Preferably, a length of the recess is longer than that of the projection in the front-rear direction.

According to this terminal fitting, not only a back surface of the recess, but also front and rear end parts of the recess can be separated from the projection.

(3) Preferably, the resilient contact portion includes a second recess on the other side end opposite to the one side end in the width direction, and the second recess is arranged at a position overlapping the recess when viewed from the width direction.

According to this terminal fitting, a stress generated when the resilient contact portion is deflected and deformed is easily evenly applied on one and the other sides in the width direction.

(4) Preferably, two wall parts arranged on both sides across the resilient contact portion, out of four wall parts constituting the body portion, respectively include protruding portions protruding inwardly in the width direction, and the protruding portions are respectively arranged at positions corresponding to the recess and the second recess.

According to this terminal fitting, a tab of a mating terminal fitting inserted into the body portion is guided by the protruding portions. The protruding portions may interfere with the resilient contact portion since protruding inwardly in the width direction. However, in this terminal fitting, the respective protruding portions are arranged at the positions corresponding to the recess and the second recess. Thus, the resilient contact portion and the protruding portions are unlikely to interfere.

(5) Preferably, the resilient contact portion includes an extending portion extending obliquely rearward from the fulcrum portion, a bent portion provided on a rear end of the extending portion, and a contact body portion extending from a rear end of the bent portion at an angle of inclination different from that of the extending portion, and the recess is provided at a position separated from the bent portion in the front-rear direction.

According to this terminal fitting, since the resilient contact portion includes the bent portion between the contact body portion and the fulcrum portion, a stress generated when the contact body portion is pressed is dispersed not only to the fulcrum portion, but also to the bent portion. Further, since the recess is provided at the position separated from the bent portion in the front-rear direction, the concentration of the stress on the bent portion can be suppressed.

(6) The chain terminal of the present disclosure includes a plurality of the terminal fittings of the present disclosure in the developed state, and a carrier extending in the width direction, wherein the plurality of terminal fittings in the developed state are coupled to the carrier while being arranged in the width direction, and the recess and the projection are arranged to face each other via a clearance between the terminal fittings adjacent in the width direction.

In this chain terminal, the recess of one terminal fitting and the projection of another terminal fitting, out of adjacent two terminal fittings, are arranged to face each other via the clearance between the terminal fittings. Thus, according to this chain terminal, an arrangement interval of the terminal fittings can be made smaller. Further, the recess is provided at the position separated from the fulcrum portion in the front-rear direction. Thus, the concentration of a stress generated when the resilient contact portion is deflected and deformed can be suppressed. Therefore, according to this chain terminal, a yield can be improved while the concentration of a stress generated when the resilient contact portion is deflected and deformed is suppressed.

Details of Embodiment of Present Disclosure

A specific example of the present disclosure is described below with reference to the drawings. Note that the present invention is not limited to these illustrations and is intended to be represented by claims and include all changes in the scope of claims and in the meaning and scope of equivalents.

Embodiment

An embodiment illustrates a terminal fitting 10 and a chain terminal 100. The terminal fitting 10 is a female terminal fitting and includes a resilient contact portion 42 configured to contact a tab 94 of a mating terminal fitting. Note that, in the following description, a side of the terminal fitting 10 to be connected to the mating terminal fitting is referred to as a front side, and a side opposite to the front side is referred to as a rear side. Further, a deflection direction of the resilient contact portion 42 is referred to as a vertical direction, a direction of deflection by being pressed by the tab 94 is referred to as an upward direction, and an opposite direction thereof is referred to as a downward direction. Further, a lateral direction when viewed from front is a lateral direction. Note that the lateral direction is equivalent to an example of a "width direction".

Figure 2:
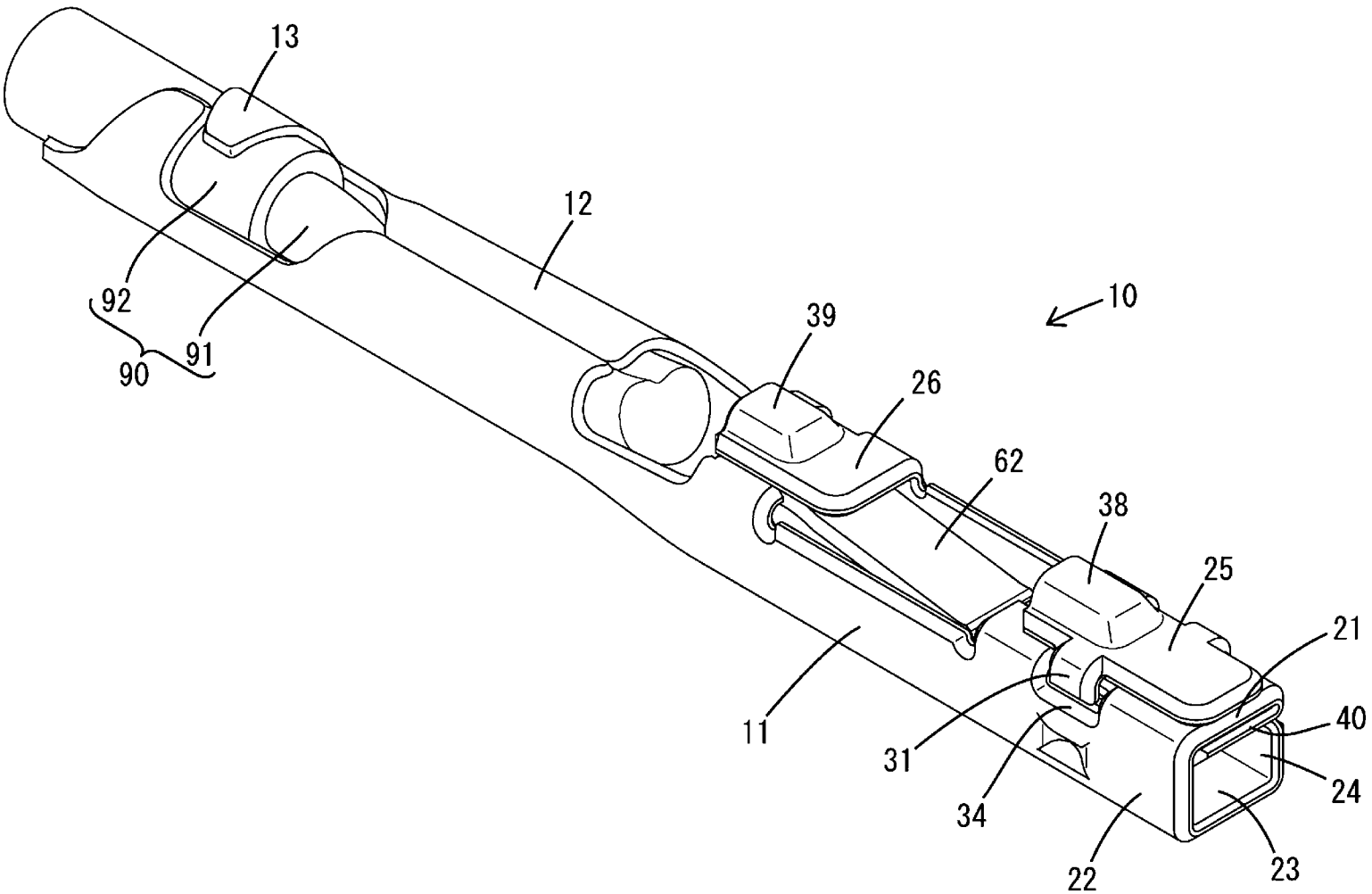
FIG. 2 is a perspective view of the terminal fitting according to the one embodiment viewed from left.

As shown in FIGS. 1 and 2, the terminal fitting 10 includes a body portion 11, a wire barrel 12 and an insulation barrel 13. The body portion 11 is in the form of a rectangular tube open in a front-rear direction, and the tab 94 of the mating terminal fitting is inserted thereinto from front. The wire barrel 12 is a part to be connected to a conductor 91 of a wire 90 and arranged behind the body portion 11. The wire barrel 12 is in the form of an open barrel and crimped to the conductor 91 exposed by removing a coating 92 on a tip part of the wire 90. The insulation barrel 13 is a part to be connected to the coating 92 of the wire 90 and arranged behind the wire barrel 12. The insulation barrel 13 is in the form of an open barrel and crimped to the coating 92 of the wire 90. In this way, the wire 90 is connected to a part of the terminal fitting 10 behind the body portion 11.

The body portion 11 includes a first plate portion 21, a second plate portion 22, a third plate portion 23, a fourth plate portion 24, a fifth plate portion 25 and a sixth plate portion 26. The first, second, third and fourth plate portions 21, 22, 23 and 24 constitute a rectangular tube, and are successively connected in a counterclockwise direction from the first plate portion 21 arranged on an upper side as a starting point when viewed from front. The fifth plate portion 25 is connected to the upper end of the fourth plate portion 24 and arranged along the outer side surface of the first plate portion 21. The first and fifth plate portions 21, 25 are arranged only in a front part of the body portion 11. The sixth plate portion 26 is connected to the upper end of the fourth plate portion 24 at a position separated rearward from the first and fifth plate portions 21, 25. The third plate portion 23 constitutes a bottom wall part of the body portion 11. The second and fourth plate portions 22, 24 constitute side wall parts of the body portion 11. The first, fifth and sixth plate portions 21, 25, 26 constitute a ceiling wall part. Note that the ceiling wall part and the left side wall part of the body portion 11 are equivalent to an example of "two wall parts adjacent across one corner of a body portion". Further, the ceiling wall part of the body portion 11 is equivalent to an example of "one wall part" and the left side wall part of the body portion 11 is equivalent to an example of "another wall part".

Figure 3:
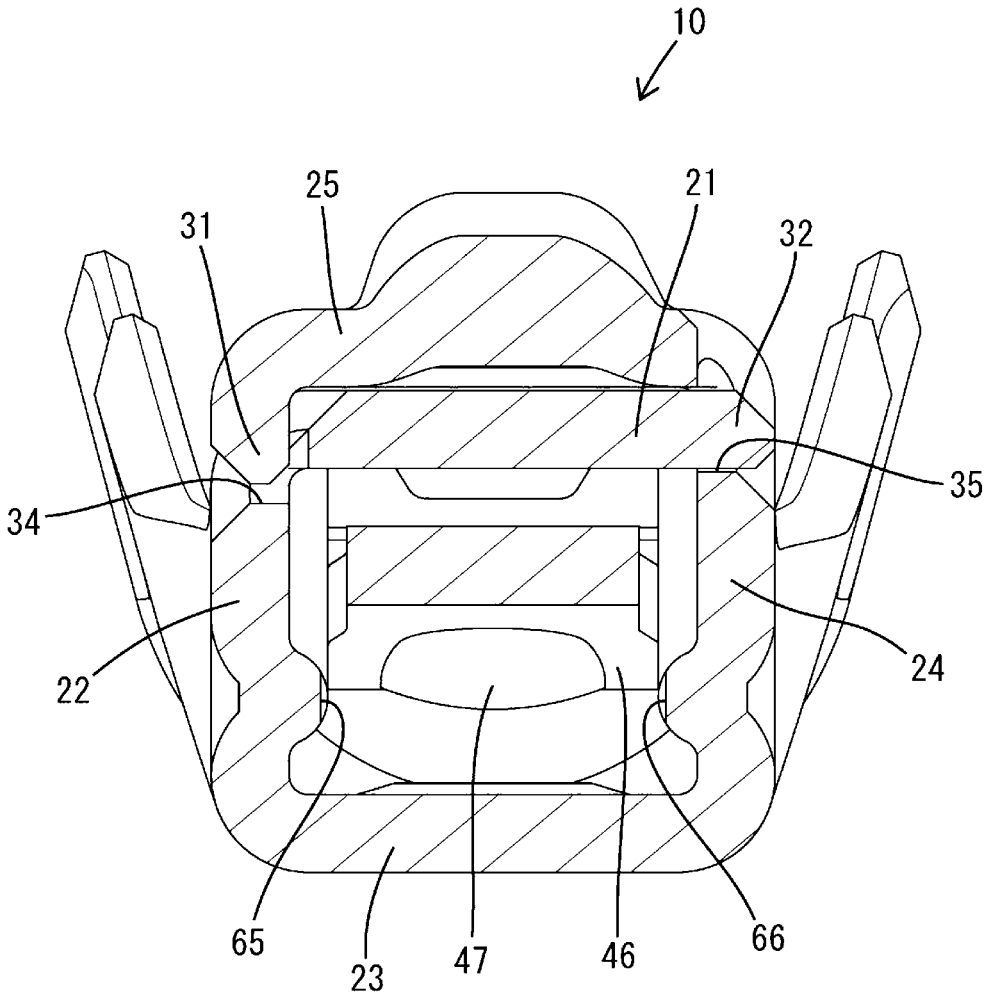
FIG. 3 is a section of a part including a first projection of the terminal fitting.

As shown in FIGS. 1 to 3, the terminal fitting 10 includes a first projection 31, a second projection 32 and a third projection 33. The body portion 11 includes a first through hole 34, a second through hole 35 and a third through hole 36. The first projection 31 is equivalent to an example of a "projection". The first projection 31 projects from the left end of the fifth plate portion 25 of the body portion 11 and extends downward. The first through hole 24 is formed to penetrate through a corner part formed by the first and second plate portions 21, 22. The first projection 31 is arranged in the first through hole 34 and projects toward the second plate portion 22. The first projection 31 is arranged to the left of the first plate portion 21 and projects further downward than the lower surface of the first plate portion 21. The second projection 32 projects rightward from the right end of the first plate portion 21. The second through hole 35 is formed to penetrate through a corner part formed by the fourth and fifth plate portions 24, 25. The second projection 32 is arranged in the second through hole 35. The third projection 33 projects rightward from the right end of a later-described second supporting portion 60 arranged along the inner side surface of the sixth plate portion 26. The third through hole 36 is formed to penetrate through a corner part formed by the fourth and sixth plate portions 24, 26. The third projection 33 is arranged in the third through hole 36.

The body portion 11 includes a cut portion 37. The cut portion 37 is arranged in a front end part of the body portion 11, penetrates through the corner part formed by the fourth and fifth plate portions 24, 25 and is open forward.

The body portion 11 includes a first rib 38 and a second rib 39. The first rib 38 projects upward from the upper surface of the fifth plate portion 25. The second rib 39 projects upward from the upper surface of the sixth plate portion 26.

Figure 4:
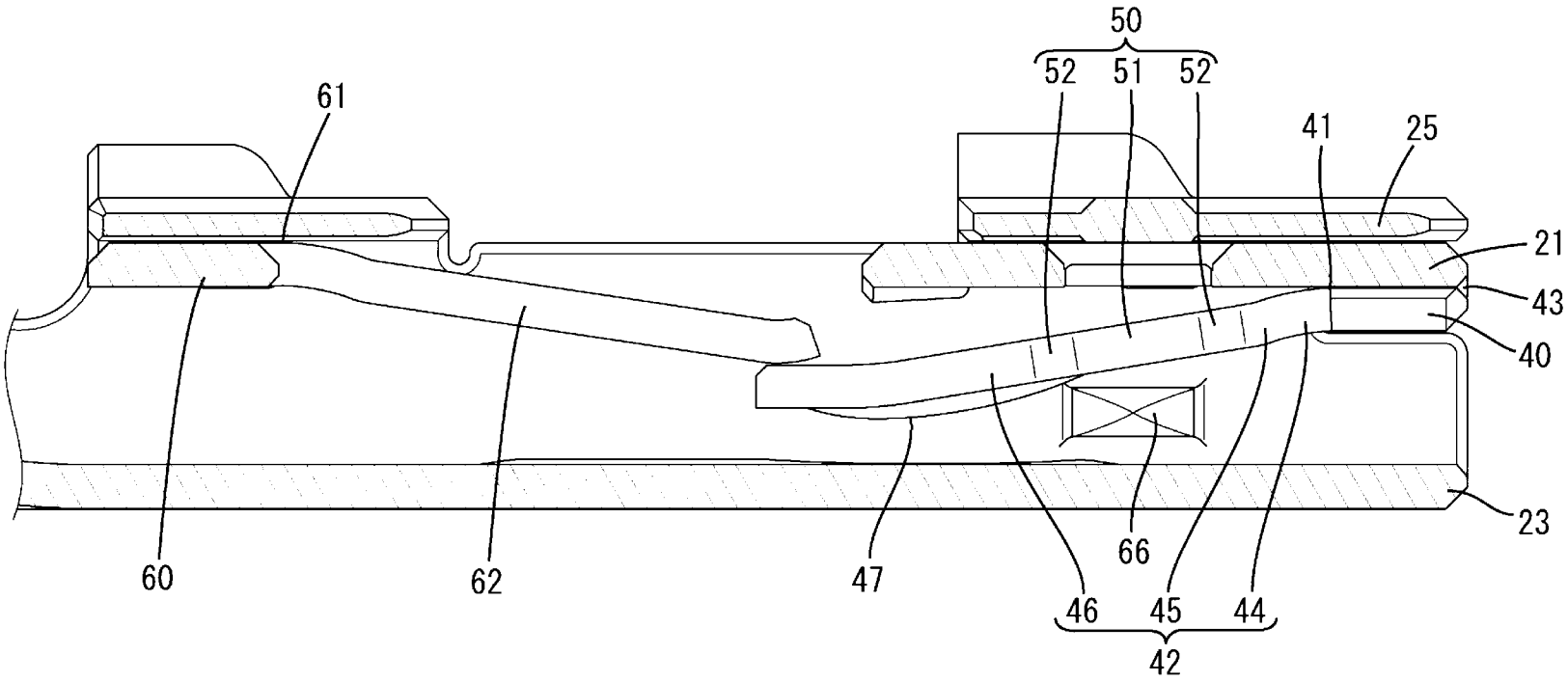
FIG. 4 is a side view in section of a body portion in the terminal fitting.
Figure 6:
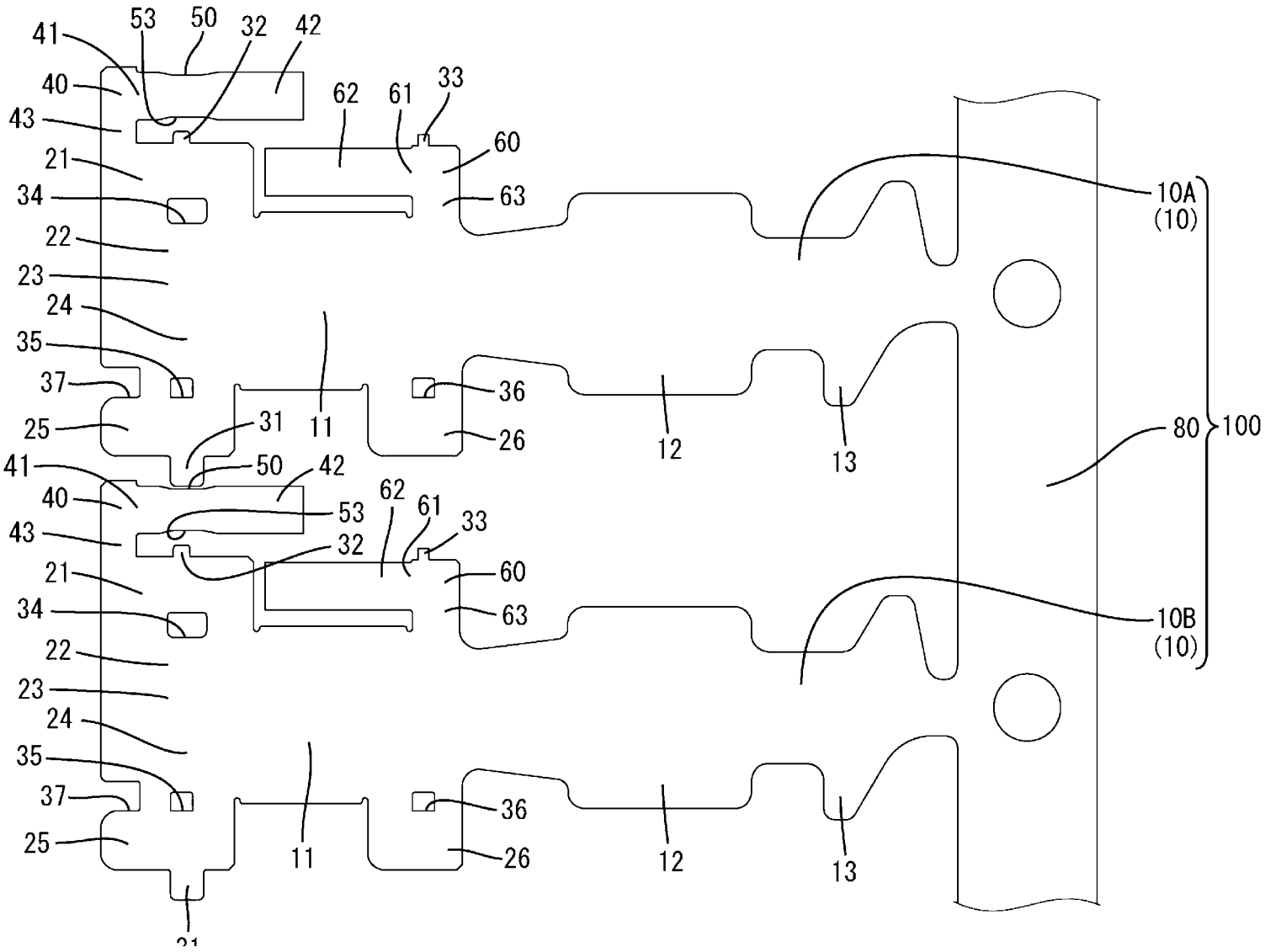
FIG. 6 is a development of the terminal fittings.

As shown in FIG. 4, the terminal fitting 10 includes a first supporting portion 40, a first fulcrum portion 41, a resilient contact portion 42 and a first coupling portion 43. The first supporting portion 40 is plate-like and has a rectangular shape long in the lateral direction in a plan view. As shown in FIG. 1, the first supporting portion 40 is coupled to a front end part of the first plate portion 21 via the first coupling portion 43 bent into a U shape, and arranged along the inner side surface of the first plate portion 21. The first fulcrum portion 41 is equivalent to an example of a "fulcrum portion". As shown in FIG. 4, the first fulcrum portion 41 is a part serving as a fulcrum when the resilient contact portion 42 is deflected and deformed, and provided on a rear end part of the first supporting portion 40. As shown in FIG. 6, the resilient contact portion 42 is in the form of a plate having a width direction aligned with the lateral direction, and has a rectangular shape long in the front-rear direction in a plan view. The resilient contact portion 42 is arranged in the body portion 11 and extends obliquely rearward (leftward in FIG. 4) from the rear end of the first fulcrum portion 41. The resilient contact portion 42 is inclined to be more separated from the first plate portion 21 toward a rear side (i.e. to come closer to the third plate portion 23 toward the rear side). The rear end of the resilient contact portion 42 is a free end, and the resilient contact portion 42 can be deflected and deformed in the vertical direction with the first fulcrum portion 41 as a fulcrum.

The resilient contact portion 42 includes an extending portion 44, a bent portion 45 and a contact body portion 46. The extending portion 44 extends obliquely rearward from the first fulcrum portion 41. A clearance is formed between the extending portion 44 and the first plate portion 21. The bent portion 45 is connected to the rear end of the extending portion 44 and bent. The contact body portion 46 is connected to the rear end of the bent portion 45 and extends obliquely rearward at an angle of inclination different from that of the extending portion 44. An angle of inclination of the contact body portion 46 with respect to the inner side surface of the first plate portion 21 is smaller than that of the extending portion 44 with respect to the inner side surface of the first plate portion 21. A length in the front-rear direction of the contact body portion 46 is longer than that of the extending portion 44. The contact body portion 46 includes a bulging portion 47 bulging downward. The bulging portion 47 has a curved surface. The tab 94 of the mating terminal fitting inserted into the body portion 11 can contact the bulging portion 47.

Figure 5:
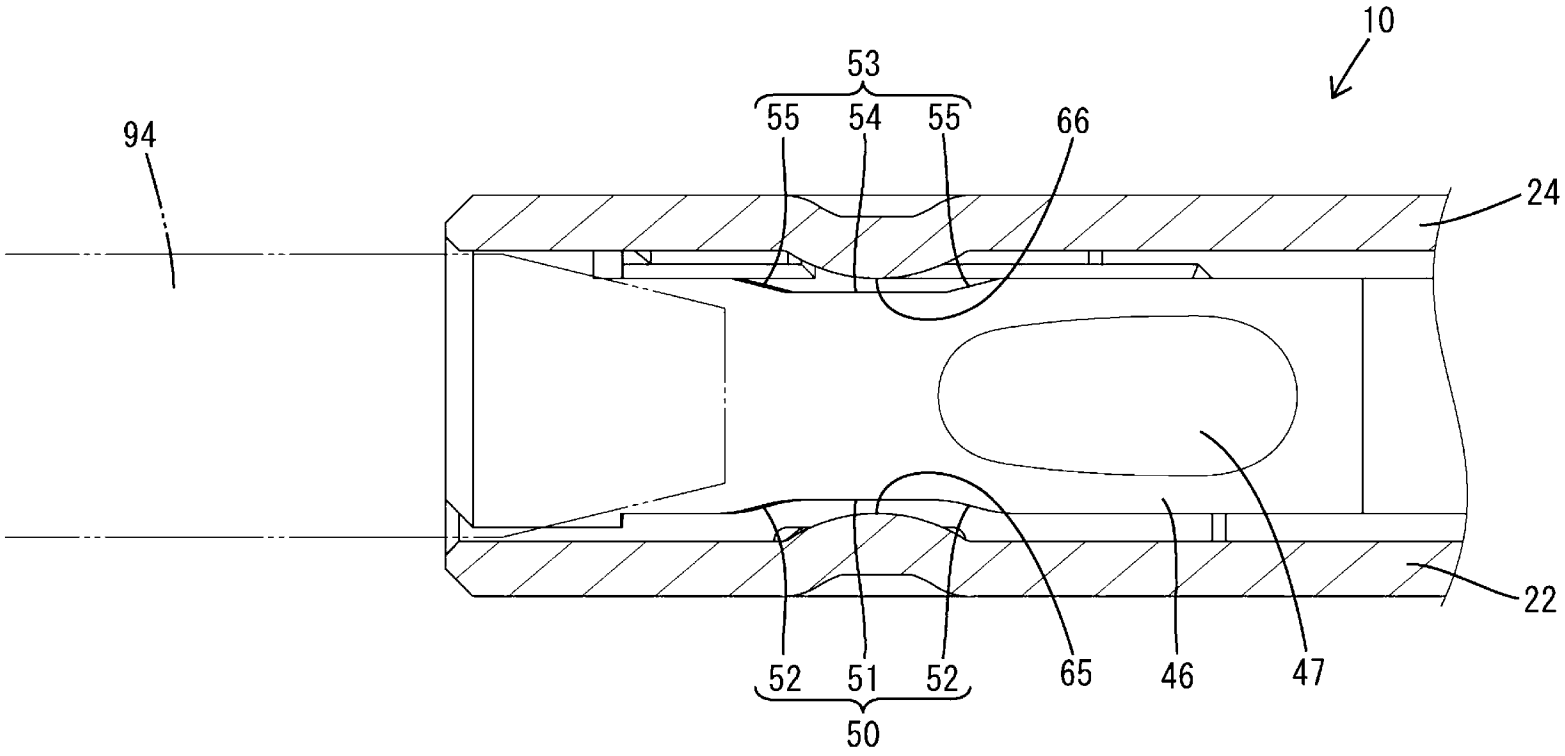
FIG. 5 is a bottom view in section of the body portion in the terminal fitting.

As shown in FIGS. 4 and 5, the contact body portion 46 includes a first recess 50. The first recess 50 is equivalent to an example of a "recess". The first recess 50 is provided in the left side surface of the contact body portion 46. The first recess 50 is formed by recessing the left side surface of the contact body portion 46 rightward, and is open leftward and in the vertical direction. An opening width in the front-rear direction of the first recess 50 is widened toward a left side. The first recess 50 has a first back surface 51 and a pair of first side surfaces 52. The first back surface 51 extends along the front-rear direction. The pair of first side surfaces 52 are respectively connected to both front and rear ends of the first back surface 51 and inclined more outwardly in the front-rear direction toward the left side. Although each of the pair of first side surface 52 is a curved surface in this embodiment, the first side surface 52 may be a flat surface.

As shown in FIG. 5, the contact body portion 46 includes a second recess 53. The second recess 53 is equivalent to an example of a "second recess". The second recess 53 is provided in the right side surface of the contact body portion 46. The second recess 53 is arranged at a position overlapping the first recess 50 when viewed from the lateral direction. The second recess 53 is formed by recessing the right side surface of the contact body portion 46 leftward, and open rightward and in the vertical direction. An opening width in the front-rear direction of the second recess 53 is widened toward a right side. The second recess 53 has a second back surface 54 and a pair of second side surfaces 55. The second back surface 54 extends along the front-rear direction. The pair of second side surfaces 55 are respectively connected to both front and rear ends of the second back surface 54 and inclined outwardly in the front-rear direction toward the right side. Although each of the pair of second side surfaces 55 is a flat surface in this embodiment, the second side surface 55 may be a curved surface.

As shown in FIG. 4, the terminal fitting 10 includes the second supporting portion 60, a second fulcrum portion 61, a deflection suppressing portion 62 and a second coupling portion 63. As shown in FIG. 6, the second supporting portion 60 is plate-like and has a rectangular shape in a plan view. The second supporting portion 60 is coupled to the upper end of a rear end part of the second plate portion 22 via the second coupling portion 63 bent at a right angle, and arranged along the inner side surface of the sixth plate portion 26. The second fulcrum portion 61 is provided on a front end part of the second supporting portion 60. The deflection suppressing portion 62 is connected to a front end part of the second supporting portion 60 via the second fulcrum portion 61 and extends obliquely forward. The deflection suppressing portion 62 is inclined to be more separated from the first plate portion 21 toward a front side (i.e. to come closer to the third plate portion 23 toward a rear side). The front end of the deflection suppressing portion 62 is a free end, and the deflection suppressing portion 62 can be deflected and deformed with the second fulcrum portion 62 as a fulcrum. A front end part of the deflection suppressing portion 62 is arranged above a rear end part of the resilient contact portion 42. Thus, when being deflected upward, the resilient contact portion 42 deflects the deflection suppressing portion 62 upward. Therefore, the upward deflection of the resilient contact portion 42 is suppressed by receiving a resilient restoring force of the deflection suppressing portion 62.

As shown in FIG. 5, the second plate portion 22 includes a first protruding portion 65, and the fourth plate portion 24 includes a second protruding portion 66. The first and second protruding portions 65, 66 are arranged on both left and right sides across the resilient contact portion 42. The first and second protruding portions 65, 66 are formed, for example, by striking. The first protruding portion 65 is shaped to protrude rightward from the inner side surface of the second plate portion 22. The first protruding portion 65 is arranged at a position corresponding to the first recess 50. Specifically, the first protruding portion 65 is arranged at a position overlapping the first recess 50 in the lateral direction in a plan view. The rightmost end of the first protruding portion 65 is aligned with the leftmost end of the contact body portion 46 in the lateral direction. The rightmost end of the first protruding portion 65 is arranged to the left of the first back surface 51 of the first recess 50. Both front and rear ends of the first protruding portion 65 are arranged inwardly of both front and rear ends of the first recess 50 in the front-rear direction.

The second protruding portion 66 is shaped to protrude leftward from the inner side surface of the fourth plate portion 24. The second protruding portion 66 is arranged at a position corresponding to the second recess 53. Specifically, the second protruding portion 66 is arranged at a position overlapping the second recess 53 in the lateral direction in a plan view. The leftmost end of the second protruding portion 66 is aligned with the rightmost end of the contact body portion 46 in the lateral direction. The leftmost end of the second protruding portion 66 is arranged to the right of the second back surface 54 of the second recess 53. Both front and rear ends of the second protruding portion 66 are arranged inwardly of both front and rear ends of the second recess 53 in the front-rear direction. A narrowest interval between the first and second protruding portions 65, 66 may be equal to, larger than or smaller than a width in the lateral direction of the tab 94 of the mating terminal fitting.

FIG. 6 shows a chain terminal 100. Here, the chain terminal 100 means such a configuration in which a plurality of the terminal fittings 10 in a developed state are coupled to a carrier 80. The chain terminal 100 includes the plurality of terminal fittings 10 in the developed state in which the aforementioned terminal fittings 10 are developed along the front-rear direction and the width direction (lateral direction in this embodiment) and the carrier 80, to which the respective terminal fittings 10 are individually coupled. The chain terminal 100 is formed by stamping a metal plate. The carrier 80 is in the form of a strip extending in the lateral direction. The respective terminal fittings 10 have rear end parts coupled to the carrier 80 while being arranged in a length direction of the carrier 80.

In the terminal fitting 10 in the developed state, the first supporting portion 40 and the resilient contact portion 42 are arranged on a left end and the first coupling portion 43, the first plate portion 21, the second plate portion 22, the third plate portion 23, the fourth plate portion 24 and the fifth plate portion 25 are successively connected and arranged toward a right side from the first supporting portion 40. The first projection 31 is formed to project rightward from the right end of the fifth plate portion 25. In this way, the tip of the first projection 31 is arranged on the right end of the terminal fitting 10 in the developed state. The first recess 50 is arranged on the left end of the resilient contact portion 42. The first recess 50, the second recess 53 and the second projection 32 are arranged at positions overlapping the first projection 31 when viewed from the lateral direction. The second recess 53 and the second projection 32 are arranged to face each other in the lateral direction.

Figure 7:
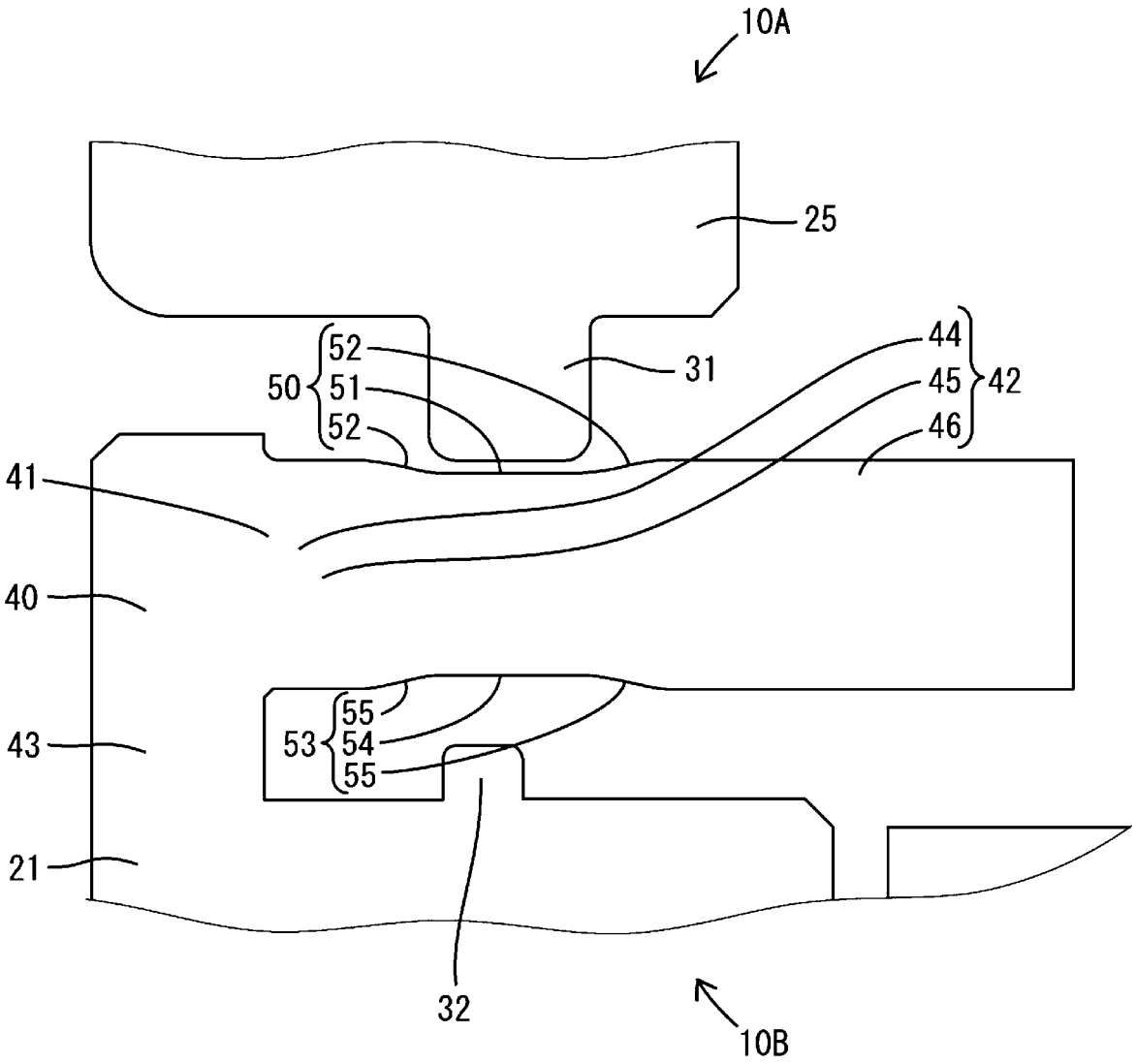
FIG. 7 is an enlarged view of adjacent parts of two terminal fittings in FIG. 6.

As shown in FIG. 7, the first projection 31 has a rectangular shape and both front and rear ends of the tip thereof are chamfered. Out of two terminal fittings 10 shown in FIG. 6, the first projection 31 of the first terminal fitting 10A on the left side is arranged to face the first recess 50 of the second terminal fitting 10B on the right side in the lateral direction. The tip of the first projection 31 of the first terminal fitting 10A is aligned with both front and rear ends of the first recess 50 of the second terminal fitting 10B in the lateral direction. A length in the front-rear direction of the first recess 50 at an opening end is longer than that of the first projection 31. An interval in the lateral direction between the first and second terminal fittings 10A, 10B is smallest between the first projection 31 and the first recess 50. For example, an interval in the lateral direction between the first projection 31 and the first recess 50 is smaller than that between the fifth plate portion 25 and the first supporting portion 40.

The terminal fittings 10 are manufactured as follows. First, the metal plate is stamped to manufacture the chain terminal 100 shown in FIG. 6. The terminal fittings 10 in the developed state in the chain terminal 100 are assembled by being individually struck and bent while being kept coupled to the carrier 80. In this way, the chained terminal fittings 10 coupled to the carrier 80 are manufactured.

As described above, in the terminal fitting 10 of this embodiment in the developed state, one side end of the resilient contact portion 42 is arranged on a left end part and the tip of the first projection 31 is arranged on a right end part. The first recess 50 is provided at the position overlapping the first projection 31 when viewed from the lateral direction on the one side end of the resilient contact portion 42. Thus, in the case of manufacturing the chain terminal 100 in which the plurality of terminal fittings 10 in the developed state are arranged in the lateral direction and individually coupled to the carrier 80, the first recess 50 of the second terminal fitting 10B, out of adjacent two terminal fittings 10, is arranged to face the first projection 31 of the first terminal fitting 10A in the lateral direction. Thus, according to this terminal fitting 10, an arrangement interval of the terminal fittings 10 in the chain terminal 10 can be made smaller. Further, the first recess 50 is provided at a position separated from the first fulcrum portion 41 in the front-rear direction. Thus, the concentration of a stress generated when the resilient contact portion 42 is deflected and deformed can be suppressed. Therefore, according to this terminal fitting 10, a yield can be improved while the concentration of a stress generated when the resilient contact portion 42 is deflected and deformed is suppressed.

Further, the length of the first recess 50 of this terminal fitting 10 is longer than that of the first projection 31. Thus, not only the first back surface 51 of the first recess 50, but alto front and rear end parts of the first recess 50 can be separated from the first projection 31.

Further, the resilient contact portion 42 of this terminal fitting 10 includes the first recess 50 on the left end and the second recess 53 on the right end. The second recess 53 is arranged at the position overlapping the first recess 50 when viewed from the lateral direction. Thus, a stress generated when the resilient contact portion 42 is deflected and deformed is easily evenly applied in the lateral direction.

Further, in this terminal fitting 10, the tab 94 of the mating terminal fitting inserted into the body portion 11 is guided by the first and second protruding portions 65, 66. The first and second protruding portions 65, 66 may interfere with the resilient contact portion 42 since protruding inwardly in the lateral direction. However, in this terminal fitting 10, the first protruding portion 65 is arranged at the position corresponding to the first recess 50, and the second protruding portion 66 is arranged at the position corresponding to the second recess 53. More specifically, in a plan view, the first protruding portion 65 is arranged at the position overlapping the first recess 50 in the lateral direction and the second protruding portion 66 is arranged at the position overlapping the second recess 53 in the lateral direction. Thus, the resilient contact portion 42 and the first and second protruding portions 65, 66 are unlikely to interfere.

Further, according to this terminal fitting 10, since the resilient contact portion 42 includes the bent portion 45 between the contact body portion 46 and the first fulcrum portion 41, a stress generated when the contact body portion 46 is pressed is dispersed not only to the first fulcrum portion 41, but also to the bent portion 45. Further, since the first recess 50 is provided at the position separated from the bent portion 45 in the front-rear direction, the concentration of the stress on the bent portion 45 can be suppressed.

Furthermore, in the chain terminal 100 of this embodiment, the first recess 50 of the second terminal fitting 10B and the first projection 31 of the first terminal fitting 10A are arranged to face each other via a clearance between the terminal fittings 10. Thus, according to this chain terminal 100, the arrangement interval of the terminal fittings 10 can be made smaller. Further, the first recess 50 is provided at the position separated from the first fulcrum portion 41 in the front-rear direction. Accordingly, the concentration of a stress generated when the resilient contact portion 42 is deflected and deformed can be suppressed. Therefore, according to this chain terminal 100, a yield can be improved while the concentration of a stress generated when the resilient contact portion 42 is deflected and deformed is suppressed.

Other Embodiments of Present Disclosure

The embodiment disclosed this time should be considered illustrative in all aspects, rather than restrictive.

(1) Although the resilient contact portion includes the extending portion and the bent portion in the above embodiment, the resilient contact portion may not include the extending portion and the bent portion.

(2) Although the fulcrum portion of the resilient contact portion is arranged on an upper side in the body portion in the above embodiment, the fulcrum portion may be arranged on a lower side in the body portion. In this case, the resilient contact portion is deflected downward by being pressed by the tab.

(3) Although the rightmost end of the first protruding portion 65 is aligned with the leftmost end of the contact body portion 46 in the lateral direction in the above embodiment, the rightmost end of the first protruding portion 65 may be arranged to the left of or to the right of the leftmost end of the contact body portion 46. Further, although the leftmost end of the second protruding portion 66 is aligned with the rightmost end of the contact body portion 46 in the lateral direction in the above embodiment, the leftmost end of the second protruding portion 66 may be arranged to the right of or to the left of the rightmost end of the contact body portion 46.

(4) Although the tip of the first projection 31 of the first terminal fitting 10A is aligned in the lateral direction with the both front and rear ends of the first recess 50 of the second terminal fitting 10B in the above embodiment, the tip of the first projection 31 may be arranged to the left of or to the right of the both front and right ends of the first recess 50 of the second terminal fitting 10B.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A terminal fitting, comprising:

a body portion in a form of a rectangular tube open in a front-rear direction;

a projection projecting from one wall part toward another wall part, out of two wall parts of the body portion adjacent across one corner;

a resilient contact portion arranged in the body portion and including a recess on one side end; and a fulcrum portion serving as a fulcrum when the resilient contact portion is deflected and deformed, wherein, in a developed state along the front-rear direction and a width direction:

the one side end of the resilient contact portion is arranged on one side end part in the width direction, a tip of the projection is arranged on another side end part in the width direction, and the recess is provided at a position overlapping the projection when viewed from the width direction and separated from the fulcrum portion in the front-rear direction on the one side end of the resilient contact portion.

2. The terminal fitting of claim 1, wherein a length of the recess is longer than that of the projection in the front-rear direction.

3. The terminal fitting of claim 1, wherein the resilient contact portion includes a second recess on the other side end opposite to the one side end in the width direction, and the second recess is arranged at a position overlapping the recess when viewed from the width direction.

4. The terminal fitting of claim 3, wherein:

two wall parts arranged on both sides across the resilient contact portion, out of four wall parts constituting the body portion, respectively include protruding portions protruding inwardly in the width direction, and the protruding portions are respectively arranged at positions corresponding to the recess and the second recess.

5. The terminal fitting of claim 1, wherein:

the resilient contact portion includes:

an extending portion extending obliquely rearward from the fulcrum portion;

a bent portion provided on a rear end of the extending portion; and a contact body portion extending from a rear end of the bent portion at an angle of inclination different from that of the extending portion, and the recess is provided at a position separated from the bent portion in the front-rear direction.

6. A chain terminal, comprising:

a plurality of the terminal fittings of claim 1 in a developed state; and a carrier extending in the width direction, wherein:

the plurality of terminal fittings are coupled to the carrier while being arranged in the width direction, and the recess and the projection are arranged to face each other via a clearance between the terminal fittings adjacent in the width direction.

7. The terminal fitting of claim 1, wherein an opening width in the front-rear direction of the recess is widened toward an outside.

* * * * *